US011381020B1

(12) United States Patent
Weaver

(10) Patent No.: US 11,381,020 B1
(45) Date of Patent: Jul. 5, 2022

(54) ELECTRICAL TERMINAL FOR MATING WITH TWO COPLANAR TABS

(71) Applicant: TE Connectivity Services GmbH, Schaffhausen (CH)

(72) Inventor: Brian Keith Weaver, Middletown, PA (US)

(73) Assignee: TE Connectivity Services GmbH, Schaffhausen (CH)

( * ) Notice: Subject to any disclaimer, the term of this patent is extended or adjusted under 35 U.S.C. 154(b) by 0 days.

(21) Appl. No.: 17/157,295

(22) Filed: Jan. 25, 2021

(51) Int. Cl.
*H01R 13/11* (2006.01)
*H01R 13/05* (2006.01)
*H01R 13/518* (2006.01)

(52) U.S. Cl.
CPC ..... *H01R 13/114* (2013.01); *H01R 13/055* (2013.01); *H01R 13/518* (2013.01)

(58) Field of Classification Search
CPC .. H01R 13/114; H01R 13/055; H01R 13/518; H01R 13/696; H01R 13/187; H01R 13/05; H01R 13/04; H01H 85/202
See application file for complete search history.

(56) References Cited

U.S. PATENT DOCUMENTS 3,555,493 A * 1/1971 Baumanis ..... H01R 12/721 439/636
4,221,456 A * 9/1980 Cairns ..... H01H 85/2035 439/723
5,004,434 A * 4/1991 Aiello ..... H01R 12/721 439/636
5,411,419 A * 5/1995 Ochi ..... H01R 13/115 439/787
5,883,561 A * 3/1999 Nakamura ..... H01H 85/0417 337/198
6,312,288 B1 * 11/2001 Genz ..... H01R 4/2454 439/628
7,988,493 B2 * 8/2011 Taniguchi ..... H01H 85/547 439/620.33
9,692,163 B1 * 6/2017 Didonato ..... H01R 13/506
10,886,654 B2 * 1/2021 Pan ..... H01R 4/185

FOREIGN PATENT DOCUMENTS

DE 102006009357 B3 * 9/2007 ..... H01R 13/187

* cited by examiner

*Primary Examiner* — Travis S Chambers

(57) ABSTRACT

An electrical terminal having a base section, a first contact leg and a second contact leg. The contact legs extend from the base section. The first contact leg has a first generally planar portion. A first curved resilient contact portion extends from a first side of the first planar portion, and a first positioning wall extending from a second side of the first planar portion. The first side of the first planar portion is opposed to the second side of the first planar portion. The second contact leg has a second generally planar portion. A second curved resilient contact portion extends from a first side of the second planar portion, and a second positioning wall extends from a second side of the second planar portion. The first side of the second planar portion is opposed to the second side of the second planar portion.

17 Claims, 4 Drawing Sheets

ELECTRICAL TERMINAL FOR MATING WITH TWO COPLANAR TABS

FIELD OF THE INVENTION

The present invention is directed to an electrical terminal for mating with two coplanar tabs. In particular, the invention is directed to an electrical terminal which properly positions and mates with tabs with minimal pitch.

BACKGROUND OF THE INVENTION

There are many terminals known in the industry for quickly mating with tabs of a mating connector or device. However, the geometry of known terminals does not affect a reliable electrical connection with mating tabs as the size of the mating tabs is reduced.

It would, therefore, be desirable to provide an electrical terminal and connector which properly positions and mates with mating tabs of minimal pitch. It would also be beneficial to provide an electrical terminal which applies sufficient mating force to the mating terminals to affect and maintain a proper electrical connection.

SUMMARY OF THE INVENTION

An embodiment is directed to an electrical terminal having a base section, a first contact leg and a second contact leg. The first contact leg extends from the base section. The first contact leg has a first generally planar portion. A first curved resilient contact portion extends from a first side of the first planar portion, and a first positioning wall extending from a second side of the first planar portion. The first side of the first planar portion is opposed to the second side of the first planar portion. The second contact leg extends from the base section. The second contact leg has a second generally planar portion. A second curved resilient contact portion extends from a first side of the second planar portion, and a second positioning wall extends from a second side of the second planar portion. The first side of the second planar portion is opposed to the second side of the second planar portion.

An embodiment is directed to an electrical connector having a housing with a base portion with a first terminal receiving portion and a second terminal receiving portion extending therefrom. An electrical terminal is positioned in the housing. The electrical terminal has a base section positioned in the base portion of the housing. A first contact leg is positioned in the first terminal receiving portion. The first contact leg has a first planar portion, a first curved resilient contact portion, and a first positioning wall. A second contact leg is positioned in the second terminal receiving portion. The second contact leg has a second planar portion, a second curved resilient contact portion, and a second positioning wall.

Other features and advantages of the present invention will be apparent from the following more detailed description of the illustrative embodiment, taken in conjunction with the accompanying drawings which illustrate, by way of example, the principles of the invention.

DETAILED DESCRIPTION OF THE INVENTION

Figure 1:
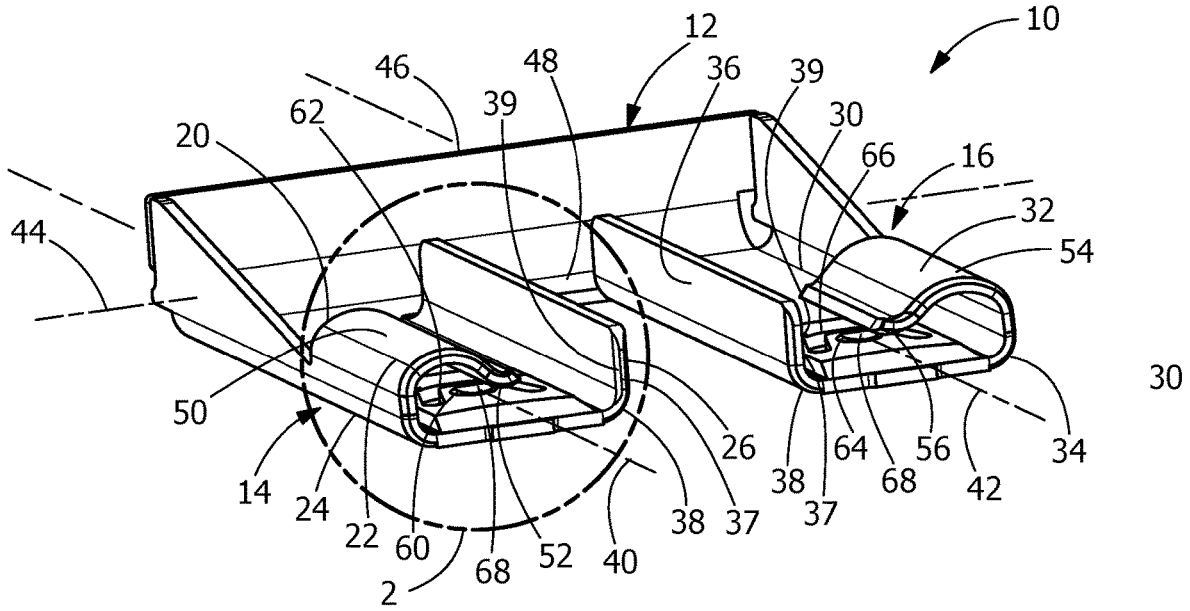
FIG. 1 is a perspective view of an illustrative embodiment of an electrical terminal of the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

As shown in FIGS. 1 through 4, an electrical terminal 10 includes a base section 12, a first contact leg 14 and a second contact leg 16. The first contact leg 14 extends from the base section 12. The first contact leg 14 has a first generally planar portion 20, a first curved resilient contact portion 22 which extends from a first side 24 of the first planar portion 20, and a first positioning wall 26 which extends from a second side 28 of the first planar portion 20. The first side 24 of the first planar portion 20 is opposed to the second side 28 of the first planar portion 20.

The second contact leg 16 extends from the base section 12. The second contact leg 16 has a second generally planar portion 30, a second curved resilient contact portion 32 which extends from a first side 34 of the second planar portion 30, and a second positioning wall 36 which extends from a second side 38 of the second planar portion 30. The first side 34 of the second planar portion 30 is opposed to the second side 38 of the second planar portion 30.

The first positioning wall 26 extends substantially angled from the first planar portion 20 of the first contact leg 14. The second positioning wall 36 extends substantially angled from the second planar portion 30 of the second contact leg 16. In an embodiment, the substantial angles of the extensions of the first positioning wall 26 and the second positioning wall 36 are substantially identical. In an embodiment, the substantial angles are greater than zero (0) degrees, and less than or equal to ninety (90) degrees, i.e., substantially perpendicular to the respective planar portions (20, 30) or less. In some embodiment, one or both the first positioning wall 26 and the second positioning wall 36 are substantially flat. In some other embodiments, one or both the first positioning wall 26 and the second positioning wall 36 are non-flat.

Figure 2:
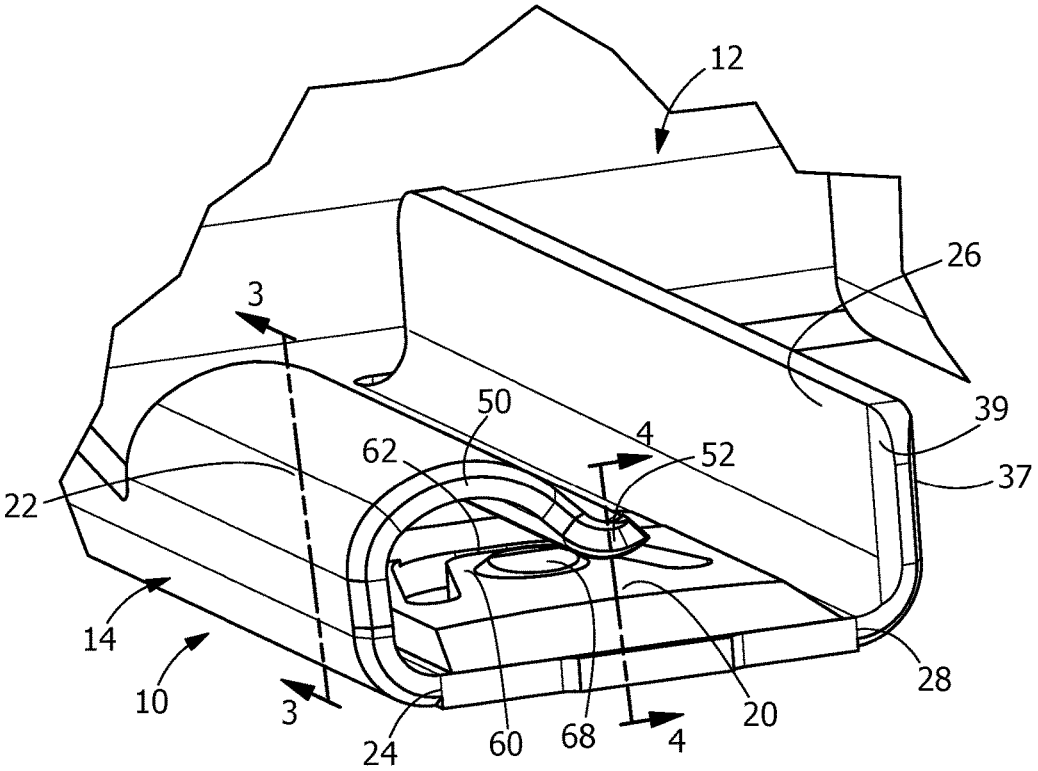
FIG. 2 is an enlarged perspective view of a contact arm of the electrical terminal shown in area 2 of FIG. 1.
Figure 3:
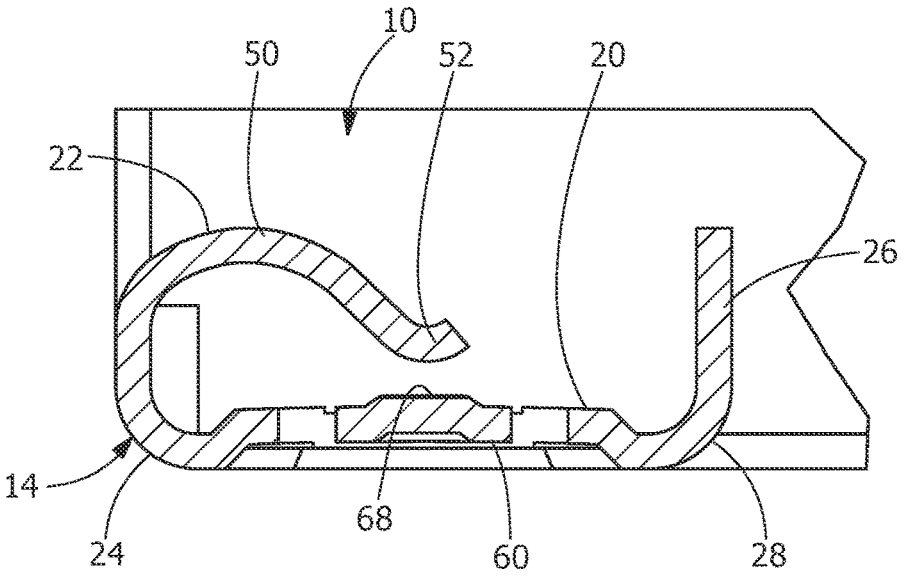
FIG. 3 is a cross-sectional view taken along line 3-3 of FIG. 2.
Figure 4:
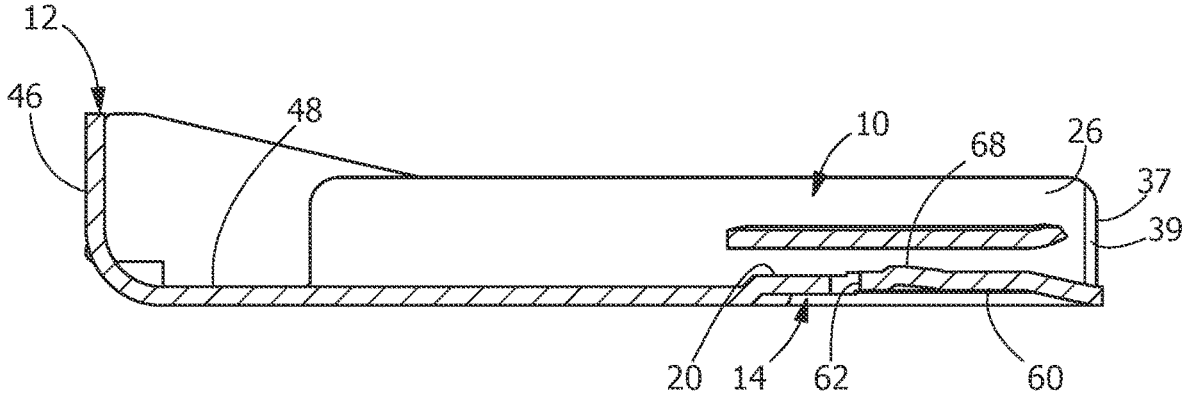
FIG. 4 is a cross-sectional view taken along line 4-4 of FIG. 2.

The second side 28 of the first planar portion 20 and the second side 38 of the second planar portion 30 are positioned adjacent each other, with or without touching each other. The first positioning wall 26 and the second positioning wall 36 extend between the first curved resilient contact arm 22 and the second resilient contact arm 32. As shown in FIG. 2, the first positioning wall 26 and the second positioning wall 36 may have tapered ends 37 which may have lead-in surfaces 39 provided thereon.

In an embodiment as shown in FIG. 1, a longitudinal axis 40 of the first contact leg 14 is substantially parallel to a longitudinal axis 42 of the second contact leg 16. The longitudinal axis 40 of the first contact leg 14 and the longitudinal axis 42 of the second contact leg 16 are substantially perpendicular to a longitudinal axis 44 of the base section 12. In some embodiment, the longitudinal axis 40 and the longitudinal axis 42 may be non-parallel. In some embodiment, they may be non-perpendicular to the longitudinal axis 44.

A push-in installation surface 46 is provided on the base section 12. The push-in installation surface 46 extends substantially perpendicular to a base planar portion 48 of the base section 12.

The first curved resilient contact portion 22 has a first arcuate section 50 which extends from the first planar portion 20 and a first tab engaging section 52 which extends from a free end of the first arcuate section 50. The second curved resilient contact portion 32 has a second arcuate section 54 which extends from the second planar portion 30 and a second tab engaging section 56 which extends from a free end of the second arcuate section 54.

As shown in FIGS. 1 through 4, the first planar portion 20 of the first contact leg 14 has a first resilient contact arm 60 formed thereon. The first resilient contact arm 60 has a first free end 62 which extends toward the first tab engaging section 52. As shown in FIG. 1, the second planar portion 30 of the second contact leg 16 has a second resilient contact arm 64 formed therein. The second resilient contact arm 64 has a second free end 66 which extends toward the second tab engaging section 56.

Projections 68 are formed in the first resilient contact arm 60 and the second resilient contact arm 64. The projections 68 extend from the first resilient contact arm 60 and the second resilient contact arm 64 in a direction toward the first tab engaging section 52 and the second tab engaging section 56.

Figure 5:
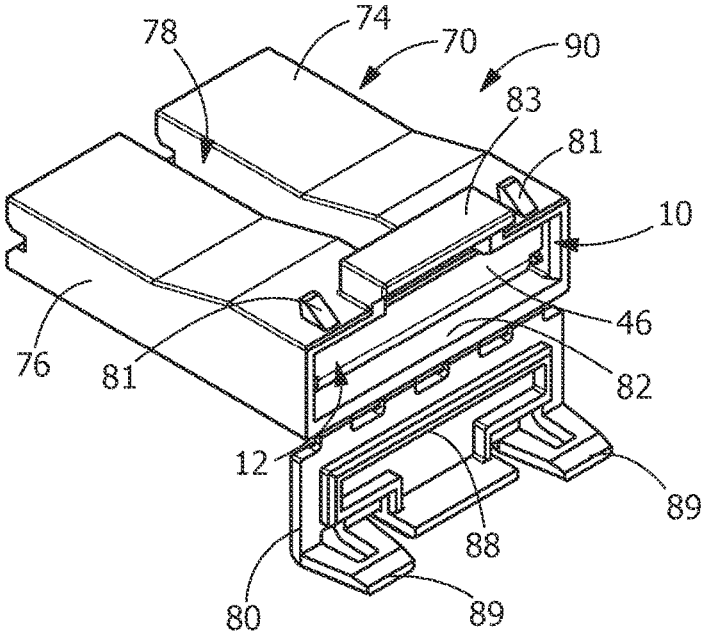
FIG. 5 is a perspective view of in illustrative embodiment of a housing for use with the electrical terminal of FIG. 1.
Figure 6:
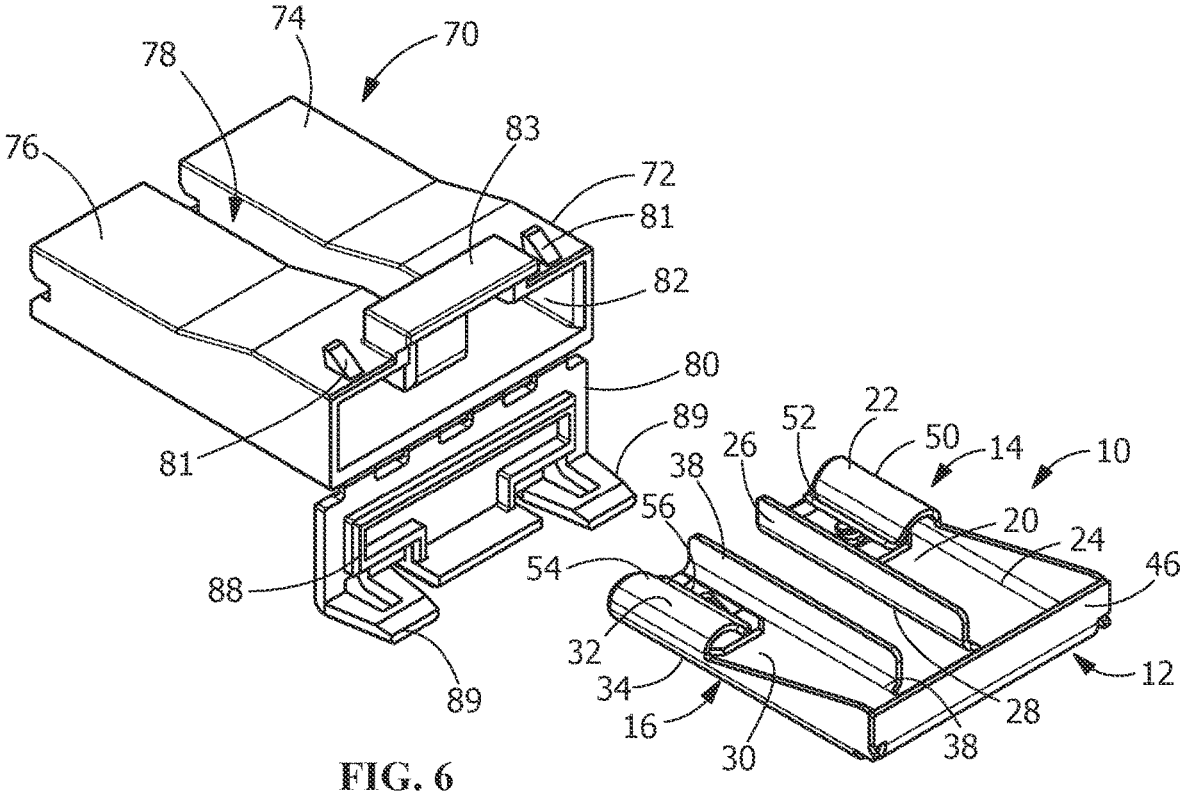
FIG. 6 is a perspective view of the electrical terminal prior to being inserted into the housing.
Figure 7:
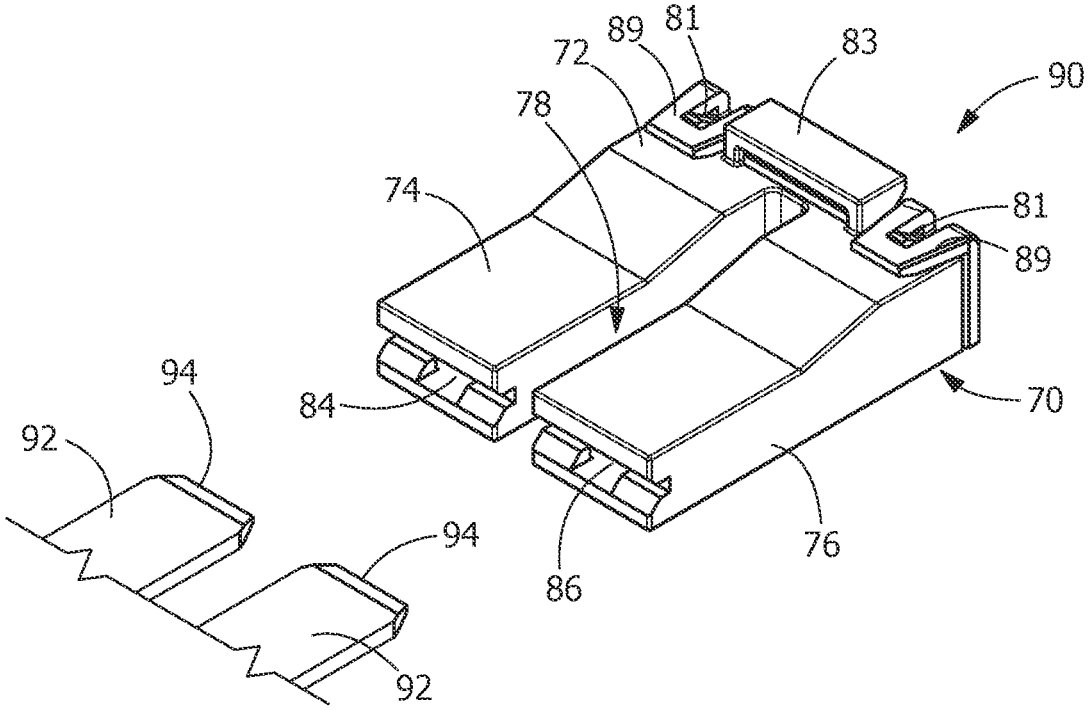
FIG. 7 is a perspective view of an electrical connector assembly with the electrical terminal fully inserted into the housing.

A housing 70, as shown in FIGS. 5 through 7 is provided to receive the electrical terminal 10 therein. The housing 70 has a base portion 72 with a first terminal receiving portion 74 and a second terminal receiving portion 76 extending from the base portion 72. The first terminal receiving portion 74 and the second terminal receiving portion 76 are separated by a cavity or slot 78. A cover 80 is hingedly attached to the base portion 72.

The base portion 72 has a base receiving cavity 82. The base receiving cavity 82 is dimensioned to receive the base section 12 of the electrical terminal 10 therein. Latching projections 81 extend from the base portion 72. A positioning member 83 also extends from the base portion 72. In the illustrative embodiment shown, the positioning member 83 is positioned between the latching projections 81, however, other configurations can be used.

The first terminal receiving portion 74 has a first terminal receiving cavity 84 in which the first contact leg 14 of the electrical terminal 10 is positioned. The first terminal receiving cavity 84 extends from the base receiving cavity 82. The first terminal receiving cavity 84 is configured to receive a first mating contact (not shown) therein.

The second terminal receiving portion 76 has a second terminal receiving cavity 86 in which the second contact leg 16 of the electrical terminal 10 is positioned. The second terminal receiving cavity 86 extends from the base receiving cavity 82. The second terminal receiving cavity 86 is configured to receive a first mating contact (not shown) therein.

The cover 80 has terminal engaging projections 88 which are configured to cooperate with the push-in installation surface 46 of the terminal 10, as will be more fully described. Latches 89 extend from the cover 80.

During assembly, the terminal 10 is inserted into the housing 70 through the base portion 72. When properly positioned: the first contact leg 14 of the terminal 10 is positioned in the first terminal receiving cavity 84 of the first terminal receiving portion 74; the second contact leg 16 of the terminal 10 is positioned in the second terminal receiving cavity 86 of the second terminal receiving portion 76; and the base section 12 of the terminal 10 is positioned in the base receiving cavity 82 of the base portion 72.

With the electrical terminal 10 properly positioned in the housing 70 the cover 80 is rotated to close the base portion 72 of the housing 70. As this occurs, the terminal engaging projections 88 of the cover 80 engage the push-in installation surface 46 of the base section 12 of the terminal 10. The engagement of the terminal engaging projections 88 of the cover 80 engage the push-in installation surface 46 causes the terminal 10 to be pushed forward in the housing 70, thereby ensuring that the first contact leg 14 and the second contact leg 16 are properly positioned in the housing 70. With the cover 80 properly rotated, the latches 89 cooperate with the latch projections 81 to secure the cover 80 in the closed position.

With the terminal 10 properly inserted and retained in the housing 70, the connector assembly 90 can be mated to mating terminals or tabs 92 (FIG. 7). The mating tabs 92 are coplanar tabs that extend from a device or are positioned in a mating connector (not shown). The mating tabs 92 have a minimal pitch or size.

As the connector assembly 90 is moved onto the mating tabs 92, free ends 94 of the mating tabs 92 are move into engagement with the first contact leg 14 and the second contact leg 16. As this occurs, the lead-in surfaces 39 of the tapered ends 37 of the first positioning wall 26 and the second positioning engage the free ends 94 to cause the free ends 94 and the mating tabs 92 to properly positioned relative to the first curved resilient contact portion 22 and the second resilient contact portion 32.

As insertion of the connector assembly 90 onto the mating tabs 92 continues, the first positioning wall 26 and the second positioning wall 36 continue to cooperate with the mating tabs 92 to properly position the mating tabs 92 in the first contact leg 14 and the second contact leg 16. This ensures that the first tab engaging section 50 and the second tab engaging section 56 are positioned inline with the mating tabs 92.

As the spacing between the first tab engaging section 50 and the projection 68 of the first resilient contact arm 60 is less than the thickness of the mating tab 92, the first tab engaging section 50 and the projection 68 engage the mating tab 92 to mechanically and electrically connect the first tab engaging section 50 and the projection 68 to the mating tab 92. This causes the first arcuate section 50 and the first resilient contact arm 60 to be moved to a stressed position, which in turn causes the first tab engaging section 50 and the projection 68 to exert a normal force on the mating tab 92. The normal force allows the first tab engaging section 50 and the projection 68 to maintain engagement with the mating tab 92 over time and over many cycles. In addition, the normal force allows the first tab engaging section 50 and the projection 68 to wipe the mating tab 92 as insertion continues to eliminate any contaminants in the engagement area.

Similarly, the spacing between the second tab engaging section 56 and the projection 68 of the second resilient contact arm 64 is less than the thickness of the mating tab 92, the second tab engaging section 56 and the projection 68 engage the mating tab 92 to mechanically and electrically connect the second tab engaging section 56 and the projection 68 to the mating tab 92. This causes the second arcuate section 56 and the second resilient contact arm 64 to be moved to a stressed position, which in turn causes the second tab engaging section 54 and the projection 68 to exert a normal force on the mating tab 92. The normal force allows the second tab engaging section 54 and the projection 68 to maintain engagement with the mating tab 92 over time and over many cycles. In addition, the normal force allows the second tab engaging section 54 and the projection 68 to wipe the mating tab 92 as insertion continues to eliminate any contaminants in the engagement area.

The terminal 10 allows the first contact leg 14 and the second contact leg 16 to act as a single terminal applying the same retention force to be applied to both mating tabs 92. The use of the positioning walls 26, 36 ensures that the mating tabs 92 will be properly positioned relative to the first resilient contact portion 22 and the second resilient contact portion 32, allowing the first tab engaging section 50 and the second tab engaging section 54 to extend over the center line of the mating tabs 92. This ensures that a proper electrical connection will be made and retained between the terminal 10 and the mating tabs 92.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

I claim:

1. An electrical terminal comprising:

a base section;

a first contact leg extending from the base section, the first contact leg having a first generally planar portion, a first curved resilient contact portion extending from a first side of the first planar portion, and a first positioning wall extending from a second side of the first planar portion, the first side of the first planar portion being opposed to the second side of the first planar portion;

a second contact leg extending from the base section, the second contact leg having a second generally planar portion, a second curved resilient contact portion extending from a first side of the second planar portion, and a second positioning wall extending from a second side of the second planar portion, the first side of the second planar portion being opposed to the second side of the second planar portion;

wherein a longitudinal axis of the first contact leg is substantially parallel to a longitudinal axis of the second contact leg, and the longitudinal axis of the first contact leg and the longitudinal axis of the second contact leg are substantially perpendicular to a longitudinal axis of the base section.

2. The electrical terminal as recited in claim 1, wherein the first positioning wall extends substantially angled from the first planar portion of the first contact leg, and the second positioning wall extends substantially angled from the second planar portion of the second contact leg.

3. The electrical terminal as recited in claim 1, wherein a push-in installation surface is provided on the base section, the push-in installation surface extends substantially perpendicular to a base planar portion of the base section.

4. An electrical terminal comprising:

a base section;

a first contact leg extending from the base section, the first contact leg having a first generally planar portion, a first curved resilient contact portion extending from a first side of the first planar portion, and a first positioning wall extending from a second side of the first planar portion, the first side of the first planar portion being opposed to the second side of the first planar portion;

a second contact leg extending from the base section, the second contact leg having a second generally planar portion, a second curved resilient contact portion extending from a first side of the second planar portion, and a second positioning wall extending from a second side of the second planar portion, the first side of the second planar portion being opposed to the second side of the second planar portion;

wherein the first curved resilient contact portion has a first arcuate section which extends from the first planar portion and a first tab engaging section which extends from a free end of the first arcuate section, and the second curved resilient contact portion has a second arcuate section which extends from the second planar portion and a second tab engaging section which extends from a free end of the second arcuate section;

wherein the first planar portion of the first contact leg has a first resilient contact arm formed thereon, the first resilient contact arm has a first free end which extends toward the first tab engaging section, and the second planar portion of the second contact leg has a second resilient contact arm formed thereon, the second resilient contact arm has a second free end which extends toward the second tab engaging section.

5. The electrical terminal as recited in claim 4, wherein projections are formed in the first resilient contact arm and the second resilient contact arm, the projections extend from the first resilient contact arm and the second resilient contact arm in a direction toward the first tab engaging section and the second tab engaging section.

6. An electrical terminal comprising:

a base section;

a first contact leg extending from the base section, the first contact leg having a first generally planar portion, a first curved resilient contact portion extending from a first side of the first planar portion, and a first positioning wall extending from a second side of the first planar portion, the first side of the first planar portion being opposed to the second side of the first planar portion;

a second contact leg extending from the base section, the second contact leg having a second generally planar portion, a second curved resilient contact portion extending from a first side of the second planar portion, and a second positioning wall extending from a second side of the second planar portion, the first side of the second planar portion being opposed to the second side of the second planar portion;

wherein the second side of the first planar portion and the second side of the second planar portion are positioned adjacent each other, wherein the first positioning wall and the second positioning wall extend between the first curved resilient contact arm and the second resilient contact arm.

7. An electrical connector comprising:

a housing having a base portion with a first terminal receiving portion and a second terminal receiving portion extending therefrom;

an electrical terminal positioned in the housing, the electrical terminal comprising:

a base section positioned in the base portion of the housing;

a first contact leg positioned in the first terminal receiving portion, the first contact leg having a first planar portion, a first curved resilient contact portion, and a first positioning wall;

a second contact leg positioned in the second terminal receiving portion, the second contact leg having a second planar portion, a second curved resilient contact portion, and a second positioning walk;

wherein a longitudinal axis of the first contact leg is substantially parallel to a longitudinal axis of the second contact leg, and the longitudinal axis of the first contact leg and the longitudinal axis of the second contact leg are substantially perpendicular to a longitudinal axis of the base section.

8. The electrical connector as recited in claim 7, wherein, the first terminal receiving portion and the second terminal receiving portion are separated by a cavity.

9. The electrical connector as recited in claim 8, wherein:

the first contact leg extends from the base section, the first curved resilient contact portion extends from a first side of the first planar portion, the first positioning wall extends from a second side of the first planar portion, and the first side of the first planar portion is opposed to the second side of the first planar portion; and the second contact leg extends from the base section, the second curved resilient contact portion extends from a first side of the second planar portion, the second positioning wall extends from a second side of the second planar portion, and the first side of the second planar portion is opposed to the second side of the second planar portion.

10. The electrical connector as recited in claim 8, wherein, the first terminal receiving portion has a first terminal receiving cavity for receiving a first mating contact therein.

11. The electrical connector as recited in claim 10, wherein the second terminal receiving portion has a second terminal receiving cavity for receiving a second mating contact therein.

12. The electrical connector as recited in claim 11, wherein a cover is hingedly attached to the base portion.

13. The electrical connector as recited in claim 7, wherein the second side of the first planar portion and the second side of the second planar portion are positioned adjacent each other, wherein the first positioning wall and the second positioning wall extend between the first curved resilient contact arm and the second resilient contact arm.

14. The electrical connector as recited in claim 13, wherein the first positioning wall extends substantially angled from the first planar portion of the first contact leg, and the second positioning wall extends substantially angled from the second planar portion of the second contact leg.

15. The electrical connector as recited in claim 14, wherein a push-in installation surface is provided on the base section, the push-in installation surface extends substantially perpendicular to a base planar portion of the base section, the push-in installation surface is positioned proximate the cover of the housing.

16. The electrical connector as recited in claim 15, wherein the first curved resilient contact portion has a first arcuate section which extends from the first planar portion and a first tab engaging section which extends from a free end of the first arcuate section, and the second curved resilient contact portion has a second arcuate section which extends from the second planar portion and a second tab engaging section which extends from a free end of the second arcuate section.

17. The electrical connector as recited in claim 16, wherein the first planar portion of the first contact leg has a first resilient contact arm formed thereon, the first resilient contact arm has a first free end which extends toward the first tab engaging section, and the second planar portion of the second contact leg has a second resilient contact arm formed thereon, the second resilient contact arm has a second free end which extends toward the second tab engaging section.

* * * * *